US006275993B1

(12) United States Patent
McCarley

(10) Patent No.: US 6,275,993 B1
(45) Date of Patent: Aug. 21, 2001

(54) CUSHION CONVERTIBLE TO A PONCHO

(76) Inventor: Tadd McCarley, 4121 W. Cooley Dr., Show Low, AZ (US) 85901

( * ) Notice: Subject to any disclaimer, the term of this patent is extended or adjusted under 35 U.S.C. 154(b) by 0 days.

(21) Appl. No.: 09/455,082

(22) Filed: Dec. 6, 1999

(51) Int. Cl.[7] ..... A41D 3/08; A41D 15/04
(52) U.S. Cl. ..... 2/84; 2/89; 2/209.11; 5/653
(58) Field of Search ..... 2/69.5, 69, 88, 2/89, 84, 209.11; 5/653

(56) References Cited

U.S. PATENT DOCUMENTS 2,150,171 * 3/1939 Kolly ..... 2/84
3,522,612 * 8/1970 Palmer ..... 2/88
4,060,852 * 12/1977 Meeks ..... 2/84
4,180,867 * 1/1980 Ridgeway, Jr. ..... 2/89
4,752,971 * 6/1988 Meserol ..... 2/88
5,257,427 * 11/1993 Hinshaw ..... 2/69.5 X
5,901,375 * 5/1999 Davis ..... 2/84

* cited by examiner

*Primary Examiner*—Peter Nerbun
(74) *Attorney, Agent, or Firm*—Jordan M. Meschkow; Lowell W. Gresham; Meschkow & Gresham, P.L.C.

(57) ABSTRACT

A cushion (20) includes a flexible body (28) and a zipper (42). The flexible body (28) is formed from a moisture repellent shell (30) and a lining (32) that can be folded and retained by closure of the zipper (42) to form the cushion (20). A handle (23) is attached to the cushion (20) for easy conveyance. The flexible body (28) also includes an opening (88) releasably sealable by a zipper (90) and a hood (96) stowed in a pocket (92). When the flexible body (28) is unfolded, the cushion is convertible to a poncho configuration (26) by placing the head of the individual (100) through the opening (88). In addition, the hood (96) may be removed from the pocket (92) and worn by the individual.

10 Claims, 4 Drawing Sheets

CUSHION CONVERTIBLE TO A PONCHO

TECHNICAL FIELD OF THE INVENTION

The present invention relates to the field of soft goods. More specifically, the present invention relates to a cushion that may be converted into apparel.

BACKGROUND OF THE INVENTION

There are many leisure time activities that are conducted outdoors. Such leisure time activities include, for example, camping, hiking, fishing, attending sporting events, and so forth. As one would expect, those individuals participating in these leisure time activities would like to stay as physically comfortable as possible, even during inclement weather. As a result, individuals often carry additional gear, such as coats and umbrellas, in case the weather should become cold and/or rainy. Unfortunately, this additional gear is cumbersome and easily mislaid since the gear may not be carried with the individual on a regular basis.

In addition, an individual may place his or her coat and umbrella in the vehicle to transport them to the site of the leisure time activity. However, due to their cumbersome nature, the individual may then leave this additional gear in the vehicle where it is not readily accessible should the weather become unexpectedly inclement.

Many people travel by car, truck, or van over long distances and into areas where the weather may become cold and/or rainy. Unfortunately, many people have suffered the ill effects of hypothermia when they were stranded in their vehicle during blizzards and rainstorms, when they were involved in an vehicular accident, or when they suffered other such emergencies because they did not carry the appropriate apparel in preparation of a potential emergency.

SUMMARY OF THE INVENTION

Accordingly, an object of the present invention is to provide an apparatus that may be used as a seat cushion and may be converted to a poncho in the event of inclement weather.

Another object of the present invention is provide a readily conveyable cushion that easily converts to a poncho.

Another object of the present invention is to provide a cushion convertible to a poncho that can be compactly stowed in a vehicle so as to be available for emergency use.

Yet another object of the present invention is to provide a cushion convertible to a poncho that is both moisture repellent and warm.

The above and other advantages of the present invention are carried out in one form by cushion convertible to a poncho to be worn by an individual. The cushion includes a flexible body having first and second surfaces bordered by a perimeter and an opening extending through the flexible body for admitting the head of the individual. A zipper is disposed on the first surface for retaining the flexible body in a folded configuration so that the second surface is concealed.

The above and other advantages of the present invention are carried out in another form by a cushion convertible to a poncho to be worn by an individual. The cushion includes a flexible body having first and second surfaces bordered by a perimeter and an opening extending through the flexible body for admitting the head of the individual. The cushion also includes means for releasably sealing the opening, and means for retaining the flexible body in a folded configuration to form the cushion, the retaining means being coupled to the flexible body.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
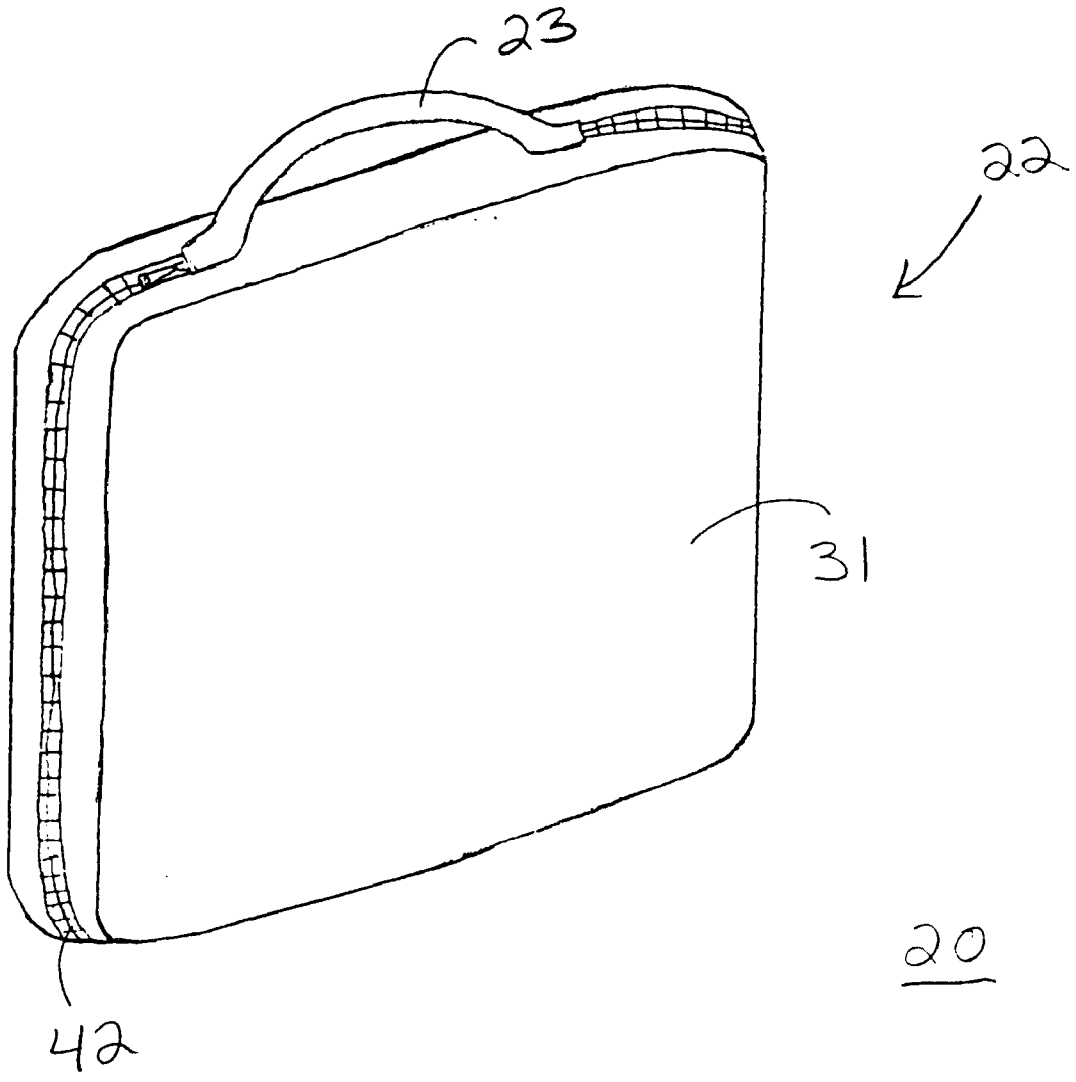
FIG. 1 shows a perspective view depicting a cushion convertible to a poncho in accordance with a preferred embodiment of the present invention.
Figure 2:
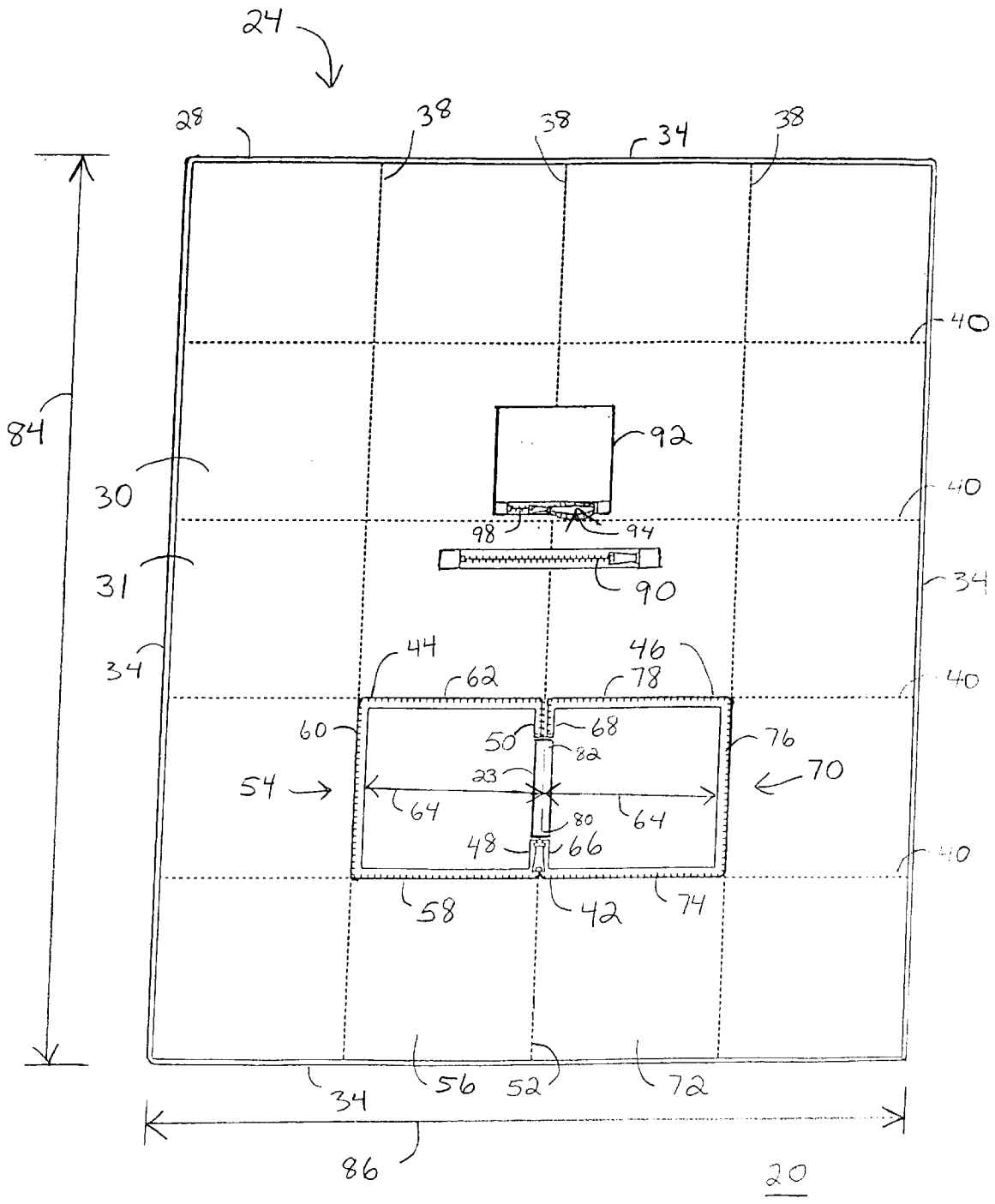
FIG. 2 shows a top view of the cushion in an unfolded configuration.
Figure 3:
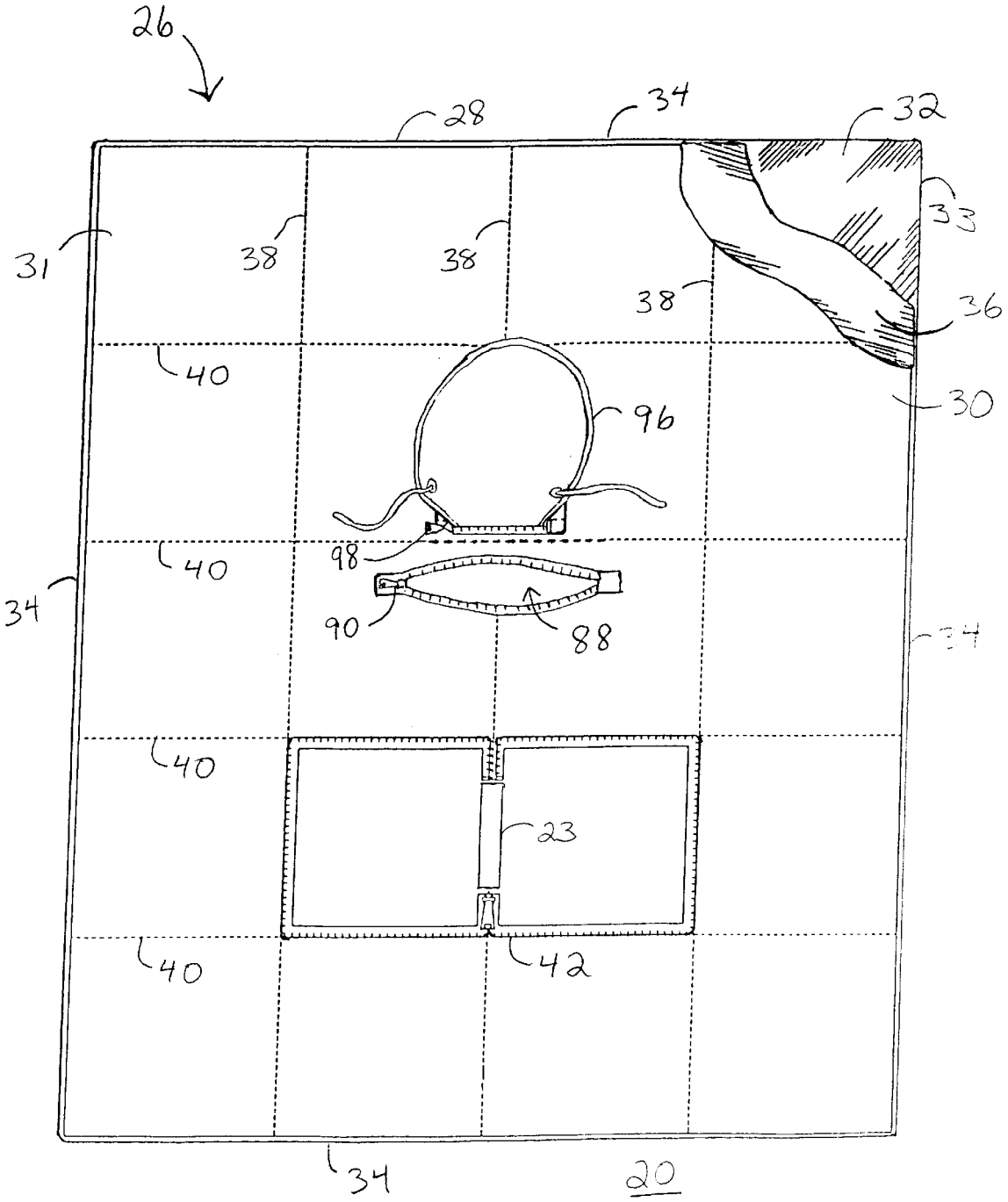
FIG. 3 shows a top partial view of the cushion converted to a poncho configuration.

Referring to FIGS. 1–3, FIG. 1 shows a perspective view of a cushion convertible to a poncho, referred to herein as a cushion 20, in accordance with a preferred embodiment of the present invention. Cushion 20 may be employed as a plush seat cushion when arranged in a folded configuration 22. In addition, cushion 20 includes a handle 23 so that cushion 20 may be readily conveyed when in folded configuration 22.

FIG. 2 shows a top view of cushion 20 in a flat, or unfolded, configuration 24, and FIG. 3 shows a top partial view of cushion 20 converted to a poncho configuration 26. Cushion 20 may be employed as a blanket, table cloth, or ground cloth, when arranged in flat configuration 24. Additionally, cushion 20 may be worn as a poncho when arranged in poncho configuration 26.

Cushion 20 includes a flexible body 28. Referring to FIG. 3 in which a corner of flexible body 28 is partially dissembled, flexible body 28 includes a moisture repellent shell 30 and a lining 32 bordered by and coupled together along a perimeter 34. In a preferred embodiment, shell 30 is formed from a nylon material having an outer surface 31 that acts as a moisture barrier between an individual sitting on cushion 20 in either of folded and unfolded configurations 22 and 24, respectively, and the ground beneath cushion 20. In addition, outer surface 31 of shell 30 repels rain when cushion 20 is in poncho configuration 26. The nylon material is also wind resistant, thus further protecting the individual from the chilling effects of excessive wind.

In the preferred embodiment, lining 32 is polyester fleece having an inner surface 33 that is configured to face an individual (see FIG. 4) when cushion 20 is in poncho configuration 26, or when cushion 20 is in unfolded configuration 24 and employed as a blanket. Inner surface 33 of lining 32 provides warmth and comfort to the user of cushion 20. An insulation layer 36 is interposed between shell 30 and lining 32 for additional warmth.

Referring collectively to FIGS. 1–3, flexible body 28 includes a first plurality of spaced-apart seams 38 that bond moisture repellent shell 30, insulation layer 36, and lining 32 together. A second plurality of spaced-apart seams 40 further bond moisture repellent shell 30, insulation layer 36, and lining 32 together. Seams 40 are arranged substantially perpendicular to seams 38. The coupling of shell 32, layer 36, and lining 32 through seams 38 and 40 serve to strengthen cushion 20 and prevent insulation layer 36 from bunching up between shell 30 and lining 32.

In a preferred embodiment, seams 38 are separated from one another by approximately fourteen inches. Likewise, seams 40 are separated from one another by approximately fourteen inches. The arrangement of seams 38 and seams 40 provide a guide for folding cushion 20 to achieve folded configuration 22. In other words, a user need only fold cushion 20 along each of seams 38 and 40 to fold cushion 20 to the appropriate size. Of course, those skilled in the art will recognize that seams 38 and 40 can be spaced apart at any distance desirable for strengthening cushion 20 and for serving as guides for folding cushion 20.

A zipper 42 is disposed on outer surface 31 for retaining flexible body 28 in folded configuration 22 such that inner surface 33 of lining 32 is concealed. Zipper 42 includes a first interlocking track 44 and a second interlocking track 46. First interlocking track 44 has first and second ends 48 and 50, respectively, lying substantially along a longitudinal centerline 52 that bisects flexible body 28. First interlocking track 44 also has a first intermediate portion 54 coupled between first and second ends 48 and 50. First intermediate portion 54 is located on a first side 56, defined by longitudinal centerline 52, of flexible body 28.

First intermediate portion 54 includes first, second, and third contiguous segments, 58, 60, and 62, respectively. First segment 58 and third segment 62 are oriented substantially perpendicular to longitudinal centerline 52. Second segment 60 is oriented substantially parallel to and displaced a distance 64 from longitudinal centerline 52.

Second interlocking track 46 is configured to mate with first interlocking track 44. Accordingly, second interlocking track 46 has third and fourth ends 66 and 68, respectively, lying substantially along longitudinal centerline 52. Second interlocking track 46 also has a second intermediate portion 70 coupled between third and fourth ends 66 and 68. Second intermediate portion 70 is located on a second side 72, defined by longitudinal centerline 52, of flexible body 28.

Second intermediate portion 70 includes fourth, fifth, and sixth contiguous segments, 74, 76, and 78, respectively. Fourth segment 74 and sixth segment 78 are oriented substantially perpendicular to longitudinal centerline 52. Fifth segment 76 is oriented substantially parallel to and displaced distance 64 from longitudinal centerline 52. When cushion 20 is arranged in folded configuration 22, and zipper 42 is engaged, first end 48 interlocks with fourth end 66, first segment 58 interlocks with fourth segment 74, second segment 60 interlocks with fifth segment 76, third segment 62 interlocks with sixth segment 78, and second end 50 interlocks with fourth end 68.

Although a zipper is employed in the preferred embodiment of the present invention, it should be readily apparent to those skilled in the art will recognized that other means for retaining the flexible body in the folded configuration may be employed. For example, Velcro, snaps, hooks, and so forth, may be used in place of zipper 42.

Handle 23 is disposed on outer surface 31 along longitudinal centerline 52. Handle 23 has a first handle end 80 coupled to outer surface 31 proximate first and third ends 48 and 66, respectively, and a second handle end 82 coupled to outer surface 31 proximate second and fourth ends 50 and 68, respectively. Accordingly, when cushion 20 is arranged in folded configuration 22 and zipper 42 is engaged, handle 23 remains exposed for easy conveyance.

Flexible body 28 exhibits a length 84 and a width 86 which is less than length 84. A slotted opening 88 located near the center of flexible body 28 extends through body 28 for admitting the head of an individual. Slotted opening 88 is oriented substantially parallel to width 86 so that when cushion 20 is in poncho configuration 26, the longer dimension, length 84, of flexible body 28 is directed over the front and back of the individual's body, and the shorter dimension, width 86, is directed toward the sides of the individual's body.

Cushion 20 further includes a zipper 90 for releasably sealing slotted opening 88. Zipper 90 is opened when cushion 20 is in poncho configuration 26 to form opening 88. Zipper 90 may also be closed to seal opening 88 when cushion 20 is in unfolded configuration 24 so that cushion 20 may be effectively utilized as a blanket or ground cover without the presence of opening 88. Those skilled in the art will recognize that other means for releasably sealing opening 88 may be employed such as Velcro, snaps, hooks, and so forth.

A pocket 92 is disposed on outer surface 31 proximate opening 88 of flexible body 28. A pocket opening 94 is oriented substantially parallel to opening 88 of flexible body 28. A hood 96 is coupled to pocket 92, and a zipper 98 is coupled to each of pocket 92 and outer surface 31 for sealing pocket opening 94. Of course, those skilled in the art will recognize that other means for releasably sealing pocket opening 94 may be employed such as Velcro, snaps, hooks, and so forth.

Typically, hood 96 is stowed in pocket 92 when cushion 20 is in folded configuration 22 or unfolded configuration 24. However, when cushion 20 is in poncho configuration 26, hood 96 may be removed from pocket 92 to be worn on the individual's head. In a preferred embodiment, pocket 92 and hood 96 are formed from water repellent nylon thus providing protection from rain and wind.

Figure 4:
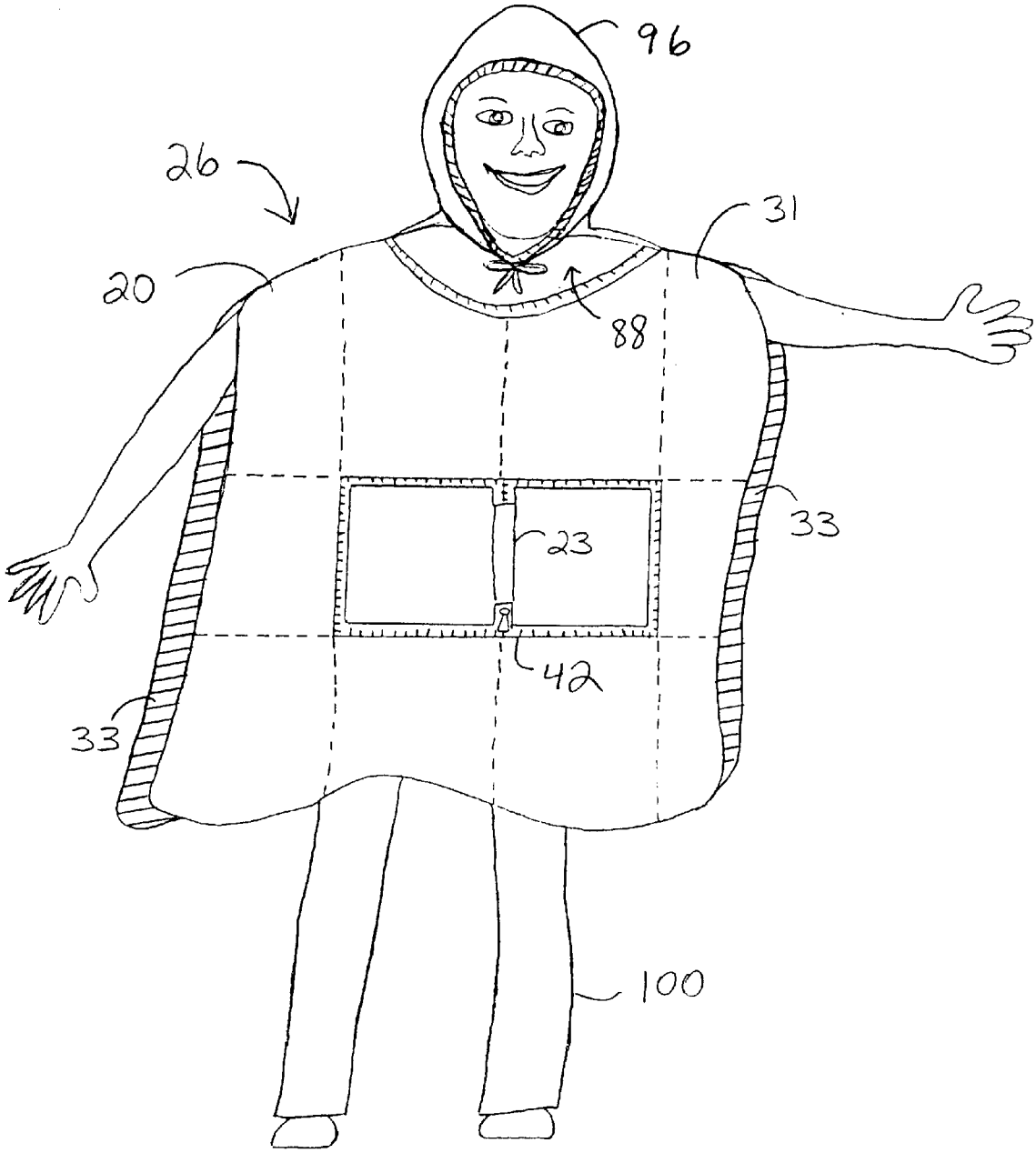
FIG. 4 shows an illustration of the cushion converted into a poncho and being worn by an individual.

FIG. 4 shows an illustration of cushion 20 converted into poncho configuration 26 and being worn by an individual 100. As shown in FIG. 4, the head of individual 100 was inserted through opening 88 and hood 96 is being worn by individual 100. Inner surface 33 of lining 32 (FIG. 3) faces individual 100 to provide warmth and comfort. Outer surface 31 of moisture repellent shell 30 faces outward to provide a moisture barrier against rain and to provide resistance to the chilling effects of wind.

In summary, the present invention teaches of a cushion convertible to a poncho for use as a seat cushion, blanket, ground cover, or poncho in the event of inclement weather. The cushion is provided with seams that serve as guides for folding the body of the cushion into a compact member for subsequent retention as a cushion through the engagement of a zipper. This compact cushion is readily stowed in a vehicle, so as to be available in the event of an emergency situation. When the cushion is in a folded configuration a handle allows the cushion to be easily conveyed to leisure time activities, such as into stadiums, so that the cushion may be used as a seat cushion until it is needed as a poncho.

Although the preferred embodiments of the invention have been illustrated and described in detail, it will be readily apparent to those skilled in the art that various modifications may be made therein without departing from the spirit of the invention or from the scope of the appended claims. For example, the flexible body may be formed from different softgoods depending upon the particular planned use for the cushion.

What is claimed is:

1. A cushion convertible to a poncho to be worn by an individual comprising:

a flexible body having first and second surfaces bordered by a perimeter and an opening extending through said body for admitting the head of said individual, said flexible body including:

a moisture repellent shell having said first surface;

a lining coupled to said shell and having said second surface;

a first plurality of spaced-apart seams coupling said shell to said lining; and a second plurality of spaced-apart seams coupling said shell to said lining, said second plurality of seams being arranged substantially perpendicular to said first plurality of seams, said first and second seams serving as guides for folding said flexible body; and a zipper disposed on said first surface for retaining said flexible body in a folded configuration so that said second surface is concealed.

2. A cushion as claimed in claim 1 wherein said flexible body further comprises an insulation layer interposed between said moisture resistant shell and said lining.

3. A cushion as claimed in claim 1 wherein said flexible body exhibits a length and a width, said length being greater than said width, and said opening is a slot oriented substantially parallel to said width.

4. A cushion as claimed in claim 1 further comprising means for releasably sealing said opening.

5. A cushion as claimed in claim 1 further comprising:

a pocket disposed on said first surface proximate said opening of said flexible body, said pocket having a pocket opening;

a hood coupled to said pocket; and means, coupled to each of said pocket and said first surface, for releasably sealing said pocket opening, wherein said hood is stowed in said pocket when said cushion is in said folded configuration, and said hood is removable from said pocket when said cushion is converted to said poncho.

6. A cushion as claimed in claim 5 wherein said pocket and said hood are formed from a moisture repellent material.

7. A cushion convertible to a poncho to be worn by an individual comprising:

a flexible body having first and second surfaces bordered by a perimeter and an opening extending through said body for admitting the head of said individual, said flexible body exhibiting a longitudinal centerline that bisects said first surface into a first side and a second side;

a zipper disposed on said first surface for retaining said flexible body in a folded configuration so that said second surface is concealed, said zipper including first and second interlocking tracks;

said first interlocking track having first and second ends lying substantially along said longitudinal centerline, and a first intermediate portion coupled between said first and second ends and located on said first side of said first surface; and said second interlocking track having third and fourth ends lying substantially along said longitudinal centerline, and a second intermediate portion coupled between said third and fourth ends and located on said second side of said first surface, such that when said zipper is engaged, said first end interlocks with said third end, said first intermediate portion interlocks with said second intermediate portion, and said second end interlocks with said fourth end.

8. A cushion as claimed in claim 7 wherein:

said first intermediate portion includes first, second, and third contiguous segments, said first and third segments being oriented substantially perpendicular to said longitudinal centerline, and said second segment being oriented substantially parallel to and displaced a first distance from said longitudinal centerline; and said second intermediate portion includes fourth, fifth, and sixth contiguous segments, said fourth and sixth segments being oriented substantially perpendicular to said longitudinal centerline, and said fifth segment being oriented substantially parallel to and displaced said first distance from said longitudinal centerline.

9. A cushion as claimed in claim 7 wherein said cushion further comprises a handle disposed on said first surface, said handle having a first handle end positioned proximate said first end and third ends, and a second handle end positioned proximate said second and fourth ends.

10. A cushion convertible to a poncho to be worn by an individual comprising:

a flexible body including a moisture repellent shell, a lining coupled to said shell, and an opening extending through said shell and said lining for admitting the head of said individual, said flexible body being configured such that said lining faces said individual when said cushion is converted to said poncho, said flexible body exhibiting a longitudinal centerline that bisects said outer surface into a first side and a second side;

a pocket disposed on an outer surface of said shell proximate said opening, said pocket having a pocket opening;

a hood coupled to said pocket, said pocket and said hood being formed from a moisture repellent material, said hood being stowed in said pocket when said cushion is in said folded configuration, and said hood being removable from said pocket when said cushion is converted to said poncho;

means, coupled to each of said pocket and said outer surface, for releasably sealing said pocket opening; and a zipper disposed on said outer surface for retaining said flexible body in a folded configuration so that said second surface is concealed, said zipper having first and second interlocking tracks;

said first interlocking track having first and second ends lying substantially along said longitudinal centerline, and a first intermediate portion coupled between said first and second ends and located on said first side of said first surface; and said second interlocking track having third and fourth ends lying substantially along said longitudinal centerline, and a second intermediate portion coupled between said third and fourth ends and located on said second side of said first surface, such that when said zipper is engaged, said first end interlocks with said third end, said first intermediate portion interlocks with said second intermediate portion, and said second end interlocks with said fourth end.

* * * * *